United States Patent [19]

Preves

[11] 3,946,168

[45] Mar. 23, 1976

[54] DIRECTIONAL HEARING AIDS

[75] Inventor: David A. Preves, Minneapolis, Minn.

[73] Assignee: Maico Hearing Instruments Inc., Kent, Wash.

[22] Filed: Sept. 16, 1974

[21] Appl. No.: 506,253

[52] U.S. Cl. ..... 179/107 FD; 179/107 H

[51] Int. Cl.[2] ..... H04R 25/02

[58] Field of Search ..... 179/107 FD, 107 H

[56] References Cited

UNITED STATES PATENTS

| | | | |
|---|---|---|---|
| 3,749,853 | 7/1973 | Ely | 179/107 H |
| 3,770,911 | 11/1973 | Knowles | 179/107 FD |
| 3,777,079 | 12/1973 | Fischer | 179/107 FD |

*Primary Examiner*—Thomas W. Brown

*Attorney, Agent, or Firm*—H. Dale Palmatier; James R. Haller

[57] ABSTRACT

A miniature hearing aid unit to be fitted to and carried on a person's head; there being a directional microphone in the housing which has front and rear sound admitting openings to respectively supply sounds to the fore and aft ports of the directional microphone; the rear opening in the hearing aid housing being located significantly closer to the inner side of the housing than the forward opening so that the alignment between front and rear openings is at an oblique angle of approximately 20° relative to the frontal direction.

5 Claims, 16 Drawing Figures

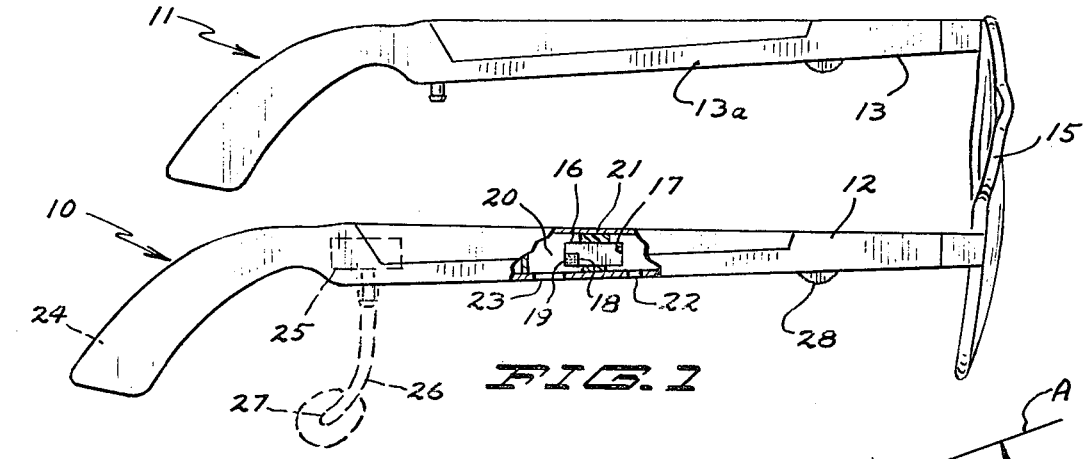
FIG. 1
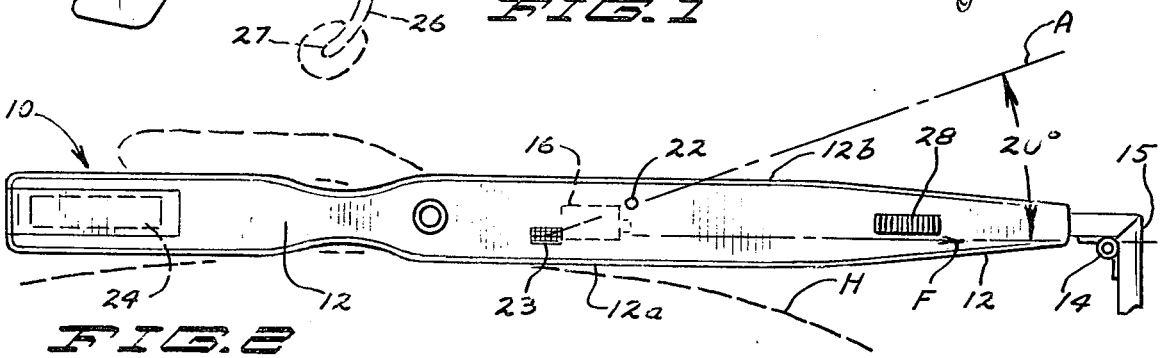
FIG. 2
FIG. 5
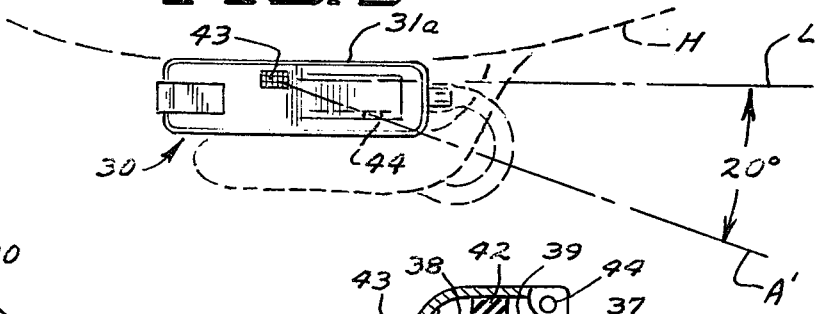
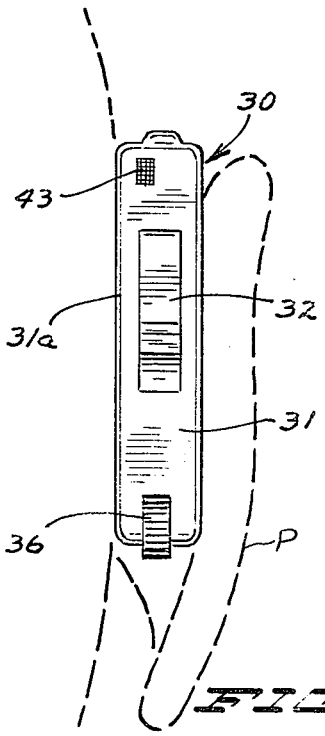
FIG. 4
FIG. 3
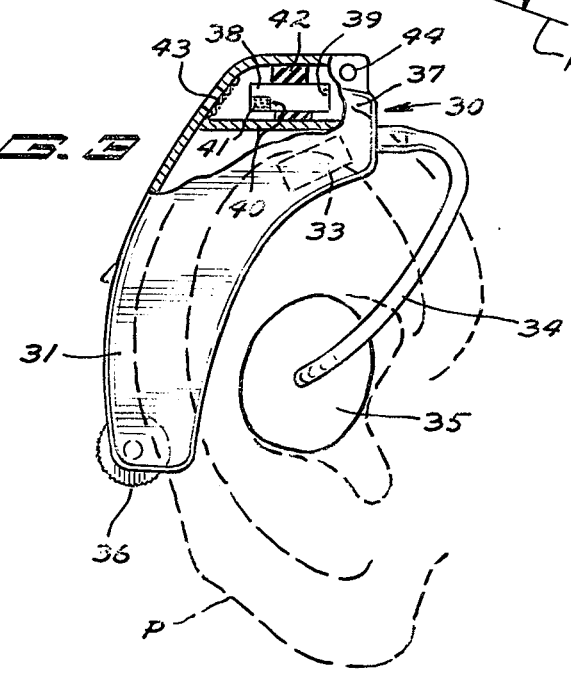

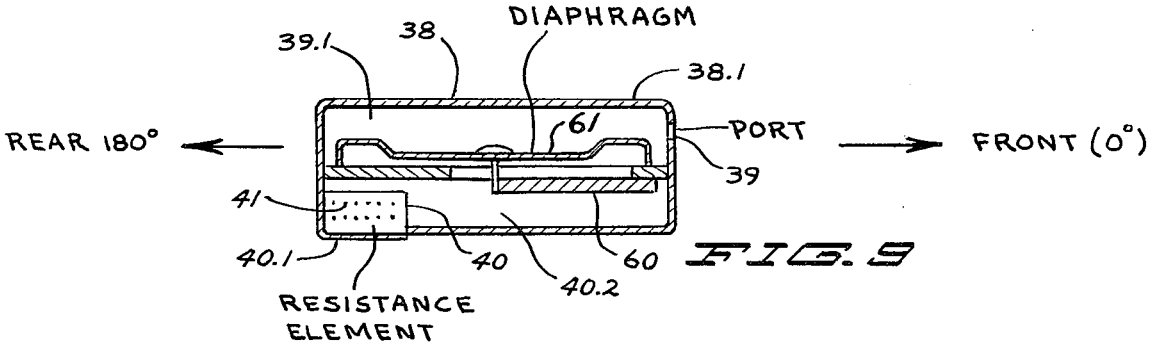
FIG. 9
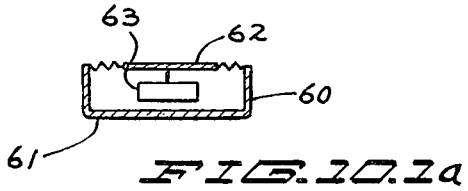
FIG. 10.2a
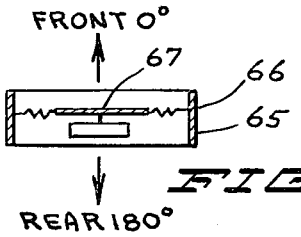
FIG. 10.4a
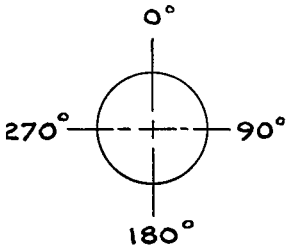
K=0
PRESSURE
FIG. 10.1
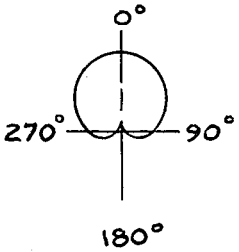
K=0.50
CARDIOID
FIG. 10.2
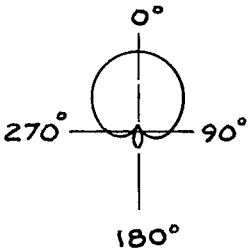
K=0.63
ULTRA CARDIOID
FIG. 10.3
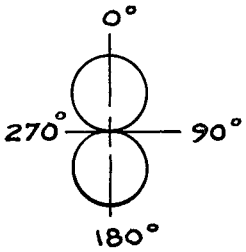
K= 1.0
COSINE OR PRESSURE GRADIENT
FIG. 10.4
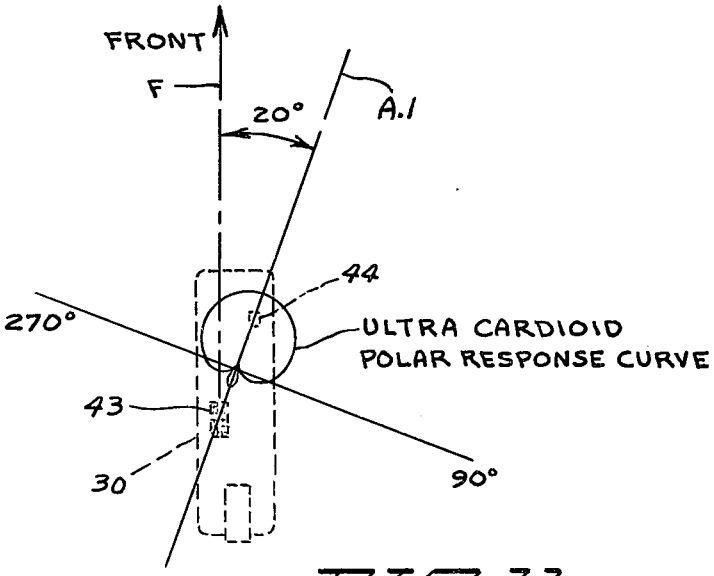
FIG. 11

DIRECTIONAL HEARING AIDS

BACKGROUND OF THE INVENTION

Head worn miniature hearing aids have been provided with a directionality feature in recent years so as to provide relatively greater amplification of sounds originating from sources in front of the person wearing the aid as compared with sounds originating generally behind the person.

The directionality feature is obtained through the use of a directional microphone in the miniature head worn hearing aid unit. Such a directional microphone has a diaphragm confined within a case which has a front sound port and also a rear sound port providing a significant acoustic resistance. Various factors have been found to influence the degree of directionality obtained through the use of such a hearing aid unit containing a directional microphone. Such factors include the magnitude of the acoustic resistance at the rear port of the microphone; other acoustic resistance within the hearing aid housing between the microphone ports and the atmosphere at the exterior of the openings in the hearing aid housing; the total length of the acoustic path from one face of the microphone diaphragm to the other face of the diaphragm; the size of the chamber within the microphone between the diaphragm and the acoustic resistance; and the frequencies of the sounds of dominant interest to the person wearing the aid.

By varying the physical dimensions of the microphone and the hearing aid housing the directivity of the hearing aid may be changed, and, if desired, may be increased.

SUMMARY OF THE INVENTION

The ability of a hearing aid to accept or reject sounds originating from different directions may be illustrated by plotting the hearing aid response on a polar graph. Variations on cardioid shaped response curves, with the largest lobe oriented to the forward direction, show desirable directional operating characteristics of the hearing aid for the purpose of rejecting noise or other sounds originating from the rear.

In determining the overall ability of the hearing aid to accept sounds from the front and to reject sounds from the rear, the overall area confined within the front part of the polar response curve from 270° forwardly around to 90° is compared to the area confined in the rear part of the curve from 90° rearwardly around to 270°.

It has been found that the ability of the hearing aid to reject sounds originating from the rear is significantly enhanced by changing the relative location or orientation of the two front and rear sound openings in the hearing aid housing. The front and rear sound openings are relocated so that, relative to each other, the rear opening is inwardly closer to the person's head, and the front opening is outwardly farther from the person's head.

It has been found that nearly maximum effect of the opening relocation is obtained when the openings are arranged so that a line extended through both front and rear openings will be oriented approximately twenty degrees to the side from the true frontal direction. Such oblique orientation of the front and rear openings, relative to each other and to the frontal direction will increase the rejection of sounds from the rear by about 15 to 20 percent.

Accordingly the relative area of the rear part of the polar response curve is decreased by approximately 20 percent.

Such reorientation of the front and rear sound receiving openings in the hearing aid housing is applicable to behind the ear or post auricle hearing aids, to eyeglass aids wherein the hearing aid is incorporated in one or both the temples of a pair of eyeglasses, or to other hearing aids wherein the microphone is carried in a separate housing on or adjacent the person's ear. In referring to head worn hearing aid units herein it is intended to include the several different variations mentioned above.

It is believed that the reorientation of the sound openings in the housing accents or emphasizes the head shadow effect which reduces the response to sounds from a direction obliquely to the rear and from the side opposite to the location of the hearing aid on the person's head.

In adapting the hearing aid to have the sound openings reoriented as prescribed, it is important that the rear opening remain unobstructed by the person's head. The changing of the orientation will change the opening-to-opening path length, and, accordingly, the acoustic resistance or microphone chamber size at the rear of the diaphragm may have to be adjusted. In order to maximize the relative ability of the hearing aid to receive sounds from the front and reject sounds from the rear, it has been found that the change in opening orientation should be coordinated with the other physical factors which affect directivity so that its polar frequency response curve has an ultracardioid shape.

By tuning the microphone of the hearing aid so that the voltage response curve of the hearing aid, plotted on polar coordinates will have an ultracardioid shaped pattern, sounds of uniform intensity from anywhere within the hemisphere in space to the front of the hearing aid will produce a marked voltage response or output from the microphone considerably in excess of the voltage response or output from the microphone owing to sounds of the same intensity and originating from locations within the hemisphere in space to the rear of the hearing aid.

Because the ultracardioid pattern of voltage response contemplates a lobe in the pattern of voltage response at a location of 180° sound incidence, or to the rear, relative to the 0° incidence of sound sources originating to the front, it is not expected that the response of the hearing aid to sounds originating directly to the rear will be as minimal as the corresponding response to such sounds originating at 180° incidence in the case of a hearing aid with a microphone tuned to the cardioid pattern. However, as compared to a hearing aid having a microphone tuned to produce a cardioid response curve, a hearing aid with the microphone tuned to produce an ultracardioid pattern response curve will have a significantly reduced response to sounds originating from other locations within the hemisphere in space to the rear of the hearing aid, and particularly from such wide angle locations with an angle of incidence of approximately 130° and 230°. On the whole, the response to the hearing aid microphone tuned to produce an ultracardioid pattern of response will have an overall significantly less response to sounds originating from random locations within the hemisphere in space to the rear of the hearing aid, and, accordingly, the overall front to back ratios of responses to sounds originating from locations within the hemispheres in space to the front and rear, respectively, of the hearing aid will be much improved.

In coordinating the use of the microphone tuned to have an ultracardioid pattern of voltage response in the directional hearing aid hereinbefore described to have the front to back orientation of the front and rear openings in the housing oriented approximately 20° to the side from the true frontal direction, the ultracardioid pattern of voltage response will be oriented to have its 0° to 180° axis in alignment with the oblique alignment of the front and rear openings in the hearing aid housing, and, accordingly, the entire ultracardioid pattern of voltage response of the hearing aid will be rotated by approximately 20° to the side. As a result, there is a significant improvement in the relative responses of the hearing aid to sounds originating from the front and rear as compared to previously known hearing aids.

DESCRIPTION OF DRAWINGS

FIG. 1 is a perspective view, partly broken away, of a pair of hearing aid units incorporated into eyeglasses to be worn on a person's head;

FIG. 2 is a bottom plan view of one of the hearing aid units of FIG. 1;

FIG. 3 is a side elevation view, partly broken away for clarity of detail, of a hearing aid unit to be worn behind a person's ear and incorporating the present invention;

FIG. 4 is a rear elevation view of the hearing aid unit of FIG. 3;

FIG. 5 is a top plan view of the hearing aid unit illustrated in FIG. 3;

FIG. 9 is a longitudinal section view through a directional microphone;

FIGS. 10.1, 10.2, 10.3 and 10.4 are polar response characteristic curves of various microphones with various characteristics:

FIGS. 10.1*a* and 10.4*a* are diagrammatic section views of pressure and pressure gradient microphones, respectively, the response characteristics of which are shown in FIGS. 10.1 and 10.4, respectively; and FIG. 11 is a polar response characteristic curve shown superimposed upon a top plan view of a directional hearing aid to which the curve relates.

DESCRIPTION OF THE INVENTION

Figure 7:
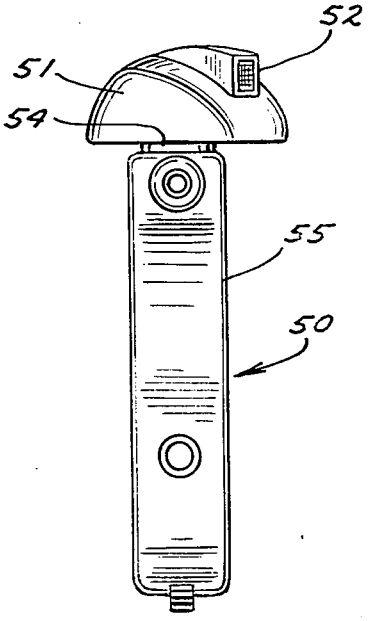
FIG. 7 is a front elevation view of the hearing aid unit illustrated in FIG. 6.

In FIGS. 1 and 2, a pair of hearing aid units 10 and 11 are incorporated in elongate slender housings 12 and 13 which are connected by hinges 14 to the front frame 15 of eyeglasses to be worn by the person. The hearing aid units 10 and 11 are essentially the same except as herein noted, and each of the hearing aid units 10 and 11 will operate independently of the other. The description of hearing aid unit 10 will suffice for an understanding of each of the hearing aid units. The hearing unit 10 incorporates a directional microphone 16 of the type illustrated and described in U.S. letters Patent No. 3,777,079 which has fore and aft ports 17 and 18 to admit sound into the interior of the microphone to opposite sides of the diaphragm. The aft port 18 of the microphone has a screen defining a plurality of extremely small apertures 19 which provide a significant acoustic resistance at the aft port 18. The microphone 16 is confined in the chamber 20 of the housing 12 and is surrounded by a belt 21 of soft cushion material which prevents sound from passing through the interior chamber 20 from the port 17 to the port 18. The housing 12 also defines a pair of front and rear openings 22 and 23 which provide access into the chamber 20 so as to admit sound to the fore and aft ports 17 and 18 of the microphone. The ports 22 and 23 offer essentially no resistance to passage of sounds therethrough, and may be regarded as being substantially acoustically transparent. The ports 22 and 23 may be entirely open or may be provided with an acoustically transparent grill or cloth covering to exclude debris and objects to avoid any damage to the microphone 16.

The hearing aid unit 10 is particularly adapted to be fitted to the side of the head adjacent the right ear, the person's head being diagrammatically illustrated in FIG. 2 by the dotted line H.

The hearing aid unit 10 also includes other portions of the hearing aid as a whole, including the battery 24, the receiver or sound producing transducer 25 from which sound is transmitted through a flexible tube 26 to an ear mold 27, and a volume control 28 which is part of the conventional transistor amplifier for receiving the electric signals from the microphone 16, and amplifying such signals which are applied to the output transducer whereupon the signals are reconverted to sound for transmission through the tube and ear mold into the person's ear.

According to the present invention, the rear opening 23 is disposed significantly closer to the inner side 12*a* of the case than the front opening 22, and, in this particular version, the front opening 22 is actually located substantially closer to the outer side 12*b* of the housing than the inner side. According to this designation, the alignment between the front and rear openings 22 and 23, as indicated by dash-dot line A, is at an oblique angle relative to the true frontal direction indicated by arrow F. It has been found that the alignment of the front and rear openings 22 and 23 relative to the true frontal direction will improve the ability of the hearing aid unit to reject sounds originating from the rear by approximately 15 to 20 percent. It has been experienced that the maximum benefit occurs when the alignment between front and rear openings relative to the true frontal direction is approximately 20° as illustrated in FIG. 2. In considering the alignment of the front and rear openings 22 and 23 relative to each other, reference is particularly made to the approximate centers of these openings 22 and 23, both of which have substantially regular shapes, the opening 22 being substantially circular and the opening 23 being rectangular. More specifically, it may be described that the centers of the front and rear openings 22 and 23 lie in an upright plane, when the hearing aid unit 10 is carried on the person's head, such that the upright plane is oriented at an oblique angle relative to another vertical reference plane that extends in a truly fore and aft direction. The angle between the reference plane and the oblique plane may be in the range of 10° to 45°, but it has been found that, at an angle of approximately 20°, the nearly maximum effect of the oblique orientation is attained for the purpose of increasing the ability of the hearing aid to reject sounds originating from the rear. This measured angle was determined in careful tests with the hearing aid mounted on and carried by a rubber mannequin head which very nearly resembles a human head in all important respects.

It should be noted that the rear opening 23 should be maintained at a distance from the inner side 12*a* of the housing so that it is unlikely that the skin of the person's head or other medium will obstruct entrance of sounds into the opening 23.

It will be recognized that, whereas hearing aids have had front and rear openings previously to supply sound into the directional microphone, the reorientation of the front and rear openings 22 and 23 relative to each other may slightly change the path length of sound from the front side of the diaphragm and around the exterior to the acoustic resistance at the rear inlet of the microphone, and, accordingly, some slight adjustment in the magnitude of the resistance at the rear port 18 of the microphone may be needed.

Preferably, in this type of hearing aid wherein the alignment of front and rear openings 22 and 23 is at an oblique angle to the true frontal direction, the several physical factors including acoustic resistance at the rear port of the microphone, path length, and interior volume of the microphone adjacent the aft port 18 should be coordinated with each other such that the frequency response of the hearing aid unit when plotted on a polar graph for sounds originating from various peripheral locations, front and back, will have a shape approximating that of an ultra-cardioid shape. This particular shape of response curve will indicate an overall maximizing of the relative ability of the hearing aid to reject sounds which originate from sources behind the person wearing the hearing aid.

It should be understood that the hearing aid unit 11 is essentially the same as hearing aid unit 10, except that the unit 11 is adapted for positioning adjacent the left side of the person's head. The rear opening in the housing 13 is positioned significantly closer to the inner side 13*a* of the housing than the front opening to the microphone chamber; and the front opening is disposed significantly farther from the inner side 13*a* of the housing than the rear opening. As in the case of hearing aid unit 10, the alignment between front and rear openings of the microphone chamber is at an oblique angle to the true frontal direction, the angle diverging in a forward direction.

The hearing aid unit 30 in FIGS. 3 – 5 has an elongate case or housing 31 which is shaped to fit confortably behind the pinna P of the person's ear. The hearing aid unit may incorporate all of the essential parts of a hearing aid in the housing 31, including a battery drawer 32 to contain the battery therein, an output transducer 33 for generating sounds from electric signals, a sound tube 34 receiving sounds from the transducer 33 and delivering such sounds to an ear mold 35 carried in the person's ear. Of course, the hearing aid unit may include an amplifier of which the volume control 36 is a part. This particular hearing aid unit 30 as illustrated is to be carried on the person's head H adjacent his right ear. The housing defines a microphone chamber 37 to confine a directional microphone 38 therein. The microphone has fore and aft sound receiving ports 39 and 40 in the case wall and the rear port is covered by a screen with a plurality of minute openings 41 defining a significant acoustic resistance. The microphone 38 is enclosed within a soft rubber belt-like cushion 42 which also prevents the sounds from migrating from one end of the chamber 37 to the other end. In this housing 31, the rear opening 43 into the chamber 37 is formed in a nearly upright portion of the case wall which faces generally rearwardly of the person. The front opening 44 is formed through an upright wall portion which faces transversely outwardly away from the person's head H and faces away from the inner side 31*a* of the housing. In this particular construction, as compared to the form illustrated in FIGS. 1 and 2 wherein both front and rear openings 22 were formed through the bottom wall of the housing, the openings 44 and 43 are formed through differently oriented wall portions of the housing, but with the same effect as is obtained in the hearing aid unit 10 as previously described.

Although the midpoint of front opening 44 is slightly higher than the midpoint of rear opening 43, the alignment, A′ between the front and rear openings is at an oblique angle relative to the true frontal direction. Again, the angle may vary anywhere from 10° to 45°, but it has been found that a preferred angle is approximately 20°. The centers of openings 44 and 43 lie in a vertical plane when the hearing aid unit 30 is carried on the person's head, which plane extends obliquely and at approximately 22° relative to a vertical reference plane indicated by the dotted line L extending in a truly fore and aft direction.

Figure 6:
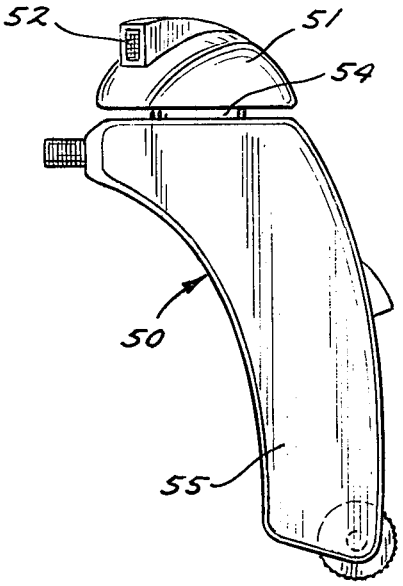
FIG. 6 is a side elevation view of another form of hearing unit to be worn behind a person's ear and incorporating the present invention.
Figure 8:
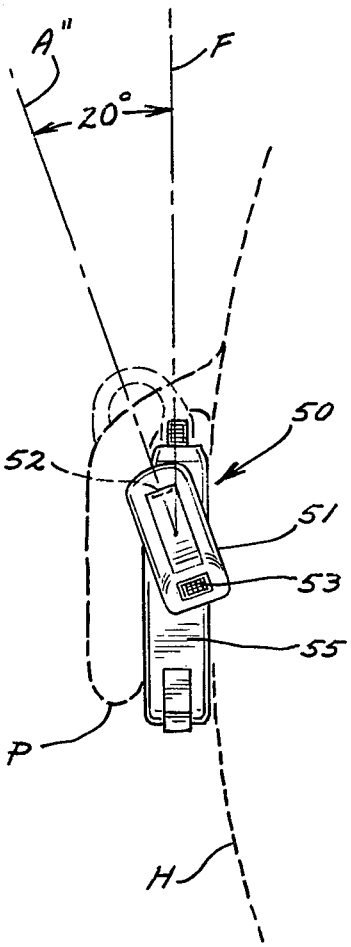
FIG. 8 is a top plan view of the hearing aid unit of FIG. 6.

In the form illustrated in FIGS. 6, 7 and 8, the hearing aid unit 50 includes an upper portion of the housing 51 defining an interior microphone chamber. The upper portion 51 of the housing confines the directional microphone therein and has front and rear openings 52 and 53, respectively, which supply sound to the directional microphone contained within the microphone chamber of housing 51. In this particular construction, the upper portion 51 of the houing is connected by a swiveling neck 54 to the main housing 55 so that the upper portion 51 of the housing may be turned at various oblique angles with respect to the main housing 55. The housing 55 is shaped to fit snugly and comfortably against the side of a person's head and behind the pinna P of his ear. The housing 51 may be turned to one side or the other relative to the housing 55 so as to orient the front and rear openings 52 and 53 in an alignment A″ at an oblique angle relative to true frontal direction F, as desired. This construction permits the oblique alignment between front and rear openings 52 and 53 to be set at a desirable twenty degrees, or at such other angle as may be comfortable and efficient for the user of the hearing aid. Likewise, this version may be adaptable to either the right or left ear by simply swinging the housing 51 to the opposite position.

According to the present invention, the orientation of the alignment between front and rear openings of the housing so that the rear opening into the microphone chamber of the housing is significantly closer to the person's head than is the front opening causes a significant increase in the ability of the hearing aid to reject sounds originating at the rear of the person. It has been found that there is a significant improvement in instances wherein the angle of orientation of the alignment between front and rear openings is in the range of 10° to 45° from true frontal direction, but it has been found that maximum effect is attained when the angle of orientation is approximately 20° as illustrated.

In FIG. 9 the microphone 38 which is employed in the behind-the-ear hearing aid 30 of FIGS. 3 – 5, is depicted in longitudinal section. This microphone 38 is oftentimes referred to as a ceramic type of microphone, and has a Piezoelectric ceramic element 60 which is attached at its free end to the diaphragm 61 so as to flex slightly and generate electric signals which constitute the output of the microphone. The ceramic element is mounted on a frame ring 60.1 which is rigid with the housing 38.1 The output is amplified in the amplifying circuitry of the hearing aid. The housing 38.1 defines the front port 39 which has no significant resistance or impedance to sound entering into the adjoining chamber 39.1 of the microphone. The rear port 40 in the housing is covered with a foil screen 40.1 which has the plurality of minute apertures 41 therein to admit sound into the adjacent chamber 40.2 of the microphone, but the minute apertures 41 provide significant resistance or impedance to the entry sounds into the rear chamber 40.2 of the microphone.

By adjusting the physical characteristics of the microphone, its operating characteristics change, and it has been found desirable to adjust the physical characteristics of the microphone when employed in the hearting aid in the manner illustrated in FIGS. 3 – 5 and 11 so that the polar response curve when plotted on a polar graph will have an ultracardioid shape as depicted in FIG. 10.3. The ultracardioid shaped response pattern is one of a number of response patterns that are obtained when the physical characteristics of a microphone are changed between a substantially true pressure type microphone which is depicted in FIG. 10.1*a*, and a pressure gradient microphone or cosine microphone which is depicted in FIG. 10.4*a*.

The pressure microphone 60 of FIG. 10.1*a* has a housing 61 which entirely encloses and excludes sound from one side of the diaphragm 62 which is carried on the housing and connected to a suitable transducer 63. The opposite face of the diaphragm 62 is fully open to the source of sound, and, accordingly, the microphone has no directional characteristics at all. As seen at FIG. 10.1 the polar response characteristic curve is a circle showing equal response to sounds from all directions. This pressure type of microphone may be considered a microphone with an infinite resistance or impedance to entry of sound into the chamber 61.1 at the rear side of the diaphram.

At the other extreme is a pressure gradient or cosine microphone 65, the housing 66 of which mounts the diaphragm 67 in an arrangement wherein both surfaces of the diaphragm are fully exposed, and there is no impedance or resistance to the sound travelling to either side of the diaphram. The output from transducer 67.1 plotted into a response curve on a polar graph for the pressure gradient microphone 65 is illustrated in FIG. 10.4; and the response curve has the shape of a FIG. 8, the microphone being equally responsive to sounds originating to the front (0°) and to the rear (180°); and the microphone being substantially nonresponsive to sounds originating from the sides, that is, 90° to 270° incidence. The microphone does not distinguish between sounds originating from the front or from the rear, and accordingly has limited value as a directional microphone.

In the past, it has been considered desirable to tune a directional microphone of a hearing aid such as microphone 38 to characteristics to produce a cardioid response curve as illustrated in FIG. 10.2. When a microphone is tuned accordingly, the microphone does have a maximum front to back ratio at 0° and 180° sound incidence, respectively; that is to say, relative to the microphone output or response to sounds originating at zero degrees incidence, or to the front, the microphone output or response to sounds originating at the rear or 180° sound incidence are most substantially attenuated. However, when the microphone is tuned to produce the cardioid pattern of response as illustrated in FIG. 10.2, the response to sounds originating from other rear locations, such as an angle of 130° or 135° incidence, will not be minimal.

It has been discovered that a hearing aid microphone, when incorporated into a hearing aid, and when tuned so that the microphone output or response pattern produces an ultracardioid pattern as illustrated in FIG. 10.3, the front to back ratio of the hearing aid is, from an overall standpoint, substantially improved as compared to the output response pattern produced when the unit is tuned to a cardioid pattern as illustrated in FIG. 10.2. Although, in the ultracardioid pattern of FIG. 10.3, the front to back ratio of microphone response to sounds originating directly to the front and directly to the rear (0° and 180°), the response to sounds originating from the rear is not attenuated quite as well as in the case of a cardioid response pattern, there is a marked reduction in response to sounds originating from other rearward locations, rearwardly between 90° and 270°. This condition has been particularly measured in a free field with the microphone tuned as described.

In the ultracardioid pattern of FIG. 10.3, there is a significantly reduced overall area within the curve to the rear side of the 90° to 270° axis as compared to the comparable area in the cardioid pattern of response of FIG. 10.2, to the rear side of the 90° to 270° axis. It has been experienced that the front to back ratio of the hearing aid, from an overall standpoint, and considering sounds originating from diverse and random locations in the hemisphere to the front of the hearing aid as compared to the similar sounds originating from diverse and random locations in the hemisphere to the rear of the hearing aid, is improved by 30 to 50 percent through the tuning of the microphone of the hearing aid to produce the ultracardioid response pattern of FIG. 10.3. This significant improvement has been measured in careful tests with the hearing aid mounted on and carried by a rubber mannequin head which very nearly resembles a human head in all important respects.

It should be recognized that there are three principal indexes or ratios which are extremely useful in measuring the effectiveness of a directional microphone or a directional microphone contained in a hearing aid.

With respect to these ratios, none of the ratios, measuring the effectiveness of a directional hearing aid, will maximize when the hearing aid is tuned to the cardioid pattern of response as illustrated in FIG. 10.2. Significant improvements in all of the indexes are noted when the microphone of the hearing aid is tuned to produce ultracardioid response pattern.

One important index to measure effectiveness is the Unidirectional Index which indicates the relative ability of the microphone or hearing aid to accept sounds arriving from the front hemisphere and to reject sounds originating from the rear hemisphere. This Unidirectional Index is measured in the form of a ratio of the energy response from the microphone to sounds of equal intensity randomly located in the front hemisphere, to energy response from the microphone to sounds of equal intensity randomly located in the hemisphere to the rear of the microphone or hearing aid. This Unidirectional Index peaks at the condition of tuning to the ultracardioid pattern and therefore this pattern of response characteristics is best for suppression of extraneous noise as compared to the desired signal to the front of the person wearing the hearing aid. For the microphone or hearing aid tuned to the ultracardioid pattern of response, the Unidirectional Index is approximately 14; as compared to 7 for the unit tuned to the cardioid pattern of characteristics; and as compared additionally to unity (1) for both of the pressure and pressure gradient microphones of FIGS. 10.1*a* and 10.4*a*.

Another important indicia is the Directivity Factor. The Directivity Factor is the ratio of power transmitted by the microphone owing to frontal sounds at 0° incidence, as compared to power transmitted by the microphone owing to random sounds of equal intensity originating from all different directions including the frontal direction. This directivity factor is approximately 3.7 for the unit tuned to the ultracardioid response pattern; as compared to 3.0 for the unit tuned to the cardioid pattern; and as compared to 1.0 for a pressure microphone; and as compared to 3.0 for a cosine or pressure gradient microphone of FIG. 10.4*a*.

The third important indicator is the Distance Factor which is the ratio of distance between the microphone and the source of sounds at the front, and the distance between the microphone and the source of randomly located sounds, and assuming that the sounds are of equal intensity at their sources. This Distance Factor varies with the square root of the Directivity Factor, and is nearly maximum for the microphone or hearing aid tuned to the ultracardioid pattern of response, the Distance Factor being approximately 1.9; as compared with a Distance Factor of approximately 1.7 for the unit tuned to the cardioid pattern of response; and as compared to a Distance Factor of 1.0 for the pressure microphone; and as compared to a Distance Factor of approximately 1.7 for the cosine or pressure gradient microphone.

It should be understood that the curve of voltage response (F) in all of the response curves of FIGS. 10.1, 10.2, 10.3, and 10.4 are produced from sounds of equal intensity originating at various polar angles ($\theta$) and is defined by the equation $F = (1.0 - K) + K \cos \theta$. As indicated in the FIGS. 10.1 – 10.4, K varies between 0 for the pressure microphone and unity (1.0) for the pressure gradient or cosine microphone; and K is related to the magnitude of the phase shift-inducing components of the microphone adjacent the rear side of the diaphragm, such components including the magnitude of the acoustic resistance or impedance defined by the minute apertures 41 in the screen, the volume of the adjoining chamber 40.2 and also the distance from the front face of the diaphragm at its center adjoining chamber 39.1 outwardly through the port 39 and thence around the exterior of the microphone, or if the microphone is confined in a hearing aid as illustrated in FIG. 3, then the distance is measured outwardly through the port 44, and around the exterior surface of the hearing aid and inwardly through the port 43 and to the rear port 40 of the microphone.

It has been determined that for a microphone or hearing aid tuned to produce a cardioid pattern of voltage response, K = 0.50; and for a microphone or hearing aid unit tuned to produce an ultracardioid curve, K = 0.63.

It has been found most expedient to adjust K by adjusting the impedance or resistance provided by the resistance element or screen 40.1. Originally when constructed, the screen 40.1 will have an excess of apertures 41 therein and, in order to tune the microphone so that an ultracardioid curve is produced, a number of the apertures 41 are simply closed with epoxy or similar material. Of course, there is a possibility also of changing the path length or distance from the front of the diaphragm to the rear port, and there is also a possibility, depending upon microphone design, to change the volume of the rear chamber 40.2.

More specifically, K is represented as a ratio, $$K = \frac{\phi_e}{\phi_e + \phi_i}$$

where $\phi_e$ is the external phase shift in radians of the audible sound moving between the front of the diaphragm and the rear port owing to the time delay caused by the additional distance the sound must travel therebetween; and wherein $\phi_i$ is the internal phase shift in radians of the sound moving from the exterior of the microphone adjacent the rear port 40 to the rear side of the diaphragm 61 in chamber 40.2 owing to the internal phase shifting components of the microphone including the resistance and the chamber volume.

It should be recognized that the fore and aft axis, that is, the 0° to 180° axis, of the polar response curve coincides with the fore and aft axis of the hearing aid which extends through the ports through which sound is received for the microphone. In such instances wherein the fore and aft ports of the hearing aid are simply oriented in a true fore and aft direction, the axis of the polar response curve coincides with the true fore and aft axis of the hearing aid, as carried on the person's head.

However, with reference to FIG. 11, which depicts the polar response curve of the hearing aid 30 of FIGS. 3 – 5, it will be understood that the axis of the plar response curve must coincide with the line A.1 which depicts the alignment between the front and rear ports 44, 43 of the hearing aid, and, in this instance, the alignment between these fore and aft ports is approximately 20° from the true frontal direction depicted by the line F in FIG. 11. Accordingly, the combined advantages of the oblique alignment of the fore and aft openings of the hearing aid relative to the true frontal direction, and the tuning of the microphone so that the polar response curve of the hearing aid has an ultracardioid shape are both incorporated into this hearing aid as depicted.

What is claimed is:

1. A miniature hearing aid unit to be worn on a person's head, comprising;

a miniature housing having means to be fitted to a side of a person's head adjacent an ear to be carried thereon in predetermined orientation relative to the front of the person's head, the housing having an inner side to face the person's head and an outer side facing away from the head and the housing also having an interior microphone chamber;

a directional microphone within said microphone chamber and having spaced fore and aft ports respectively admitting sounds to opposite sides of the diaphragm within the microphone, the aft port having a significant acoustic resistance therein; and the housing also having front and rear sound admitting openings communicating between the interior chamber and the exterior of the housing for freely supplying sound to the fore and aft ports, respectively, of the microphone, the rear opening to the chamber being disposed rearwardly of the front opening and the rear opening being spaced significantly closer to the inner side of the housing than said front opening so that the alignment between front and rear openings is at an oblique angle relative to the frontal direction.

2. The miniature hearing aid unit according to claim 1 wherein said alignment is at an angle of approximately 20° and is forwardly diverging from the frontal direction.

3. The miniature hearing aid unit according to claim 1 and said housing having variously oriented walls defining the microphone chamber, said front and rear sound admitting openings being located in certain of the walls such that the openings will be intersected by a vertical plane which diverges obliquely in a forward direction away from the inner side of the housing.

4. The miniature hearing aid unit according to claim 3 wherein said vertical plane is oriented approximately twenty degrees with respect to another vertical reference plane which lies in a true fore and aft direction.

5. The miniature hearing aid unit according to claim 1 wherein the housing has an elongate and generally upright shape to fit behind the pinna of the person's ear, the microphone chamber and sound admitting openings being disposed adjacent the upper end of the housing.

* * * * *